US010472938B2

(12) United States Patent
Parks et al.

(10) Patent No.: US 10,472,938 B2
(45) Date of Patent: Nov. 12, 2019

(54) PERFORATION GUN COMPONENTS AND SYSTEM

(71) Applicant: DynaEnergetics GmbH & Co. KG, Troisdorf (DE)

(72) Inventors: David C. Parks, Calgary (CA); Frank Haron Preiss, Bonn (DE); Liam McNelis, Bonn (DE); Eric Mulhern, Edmonton (CA); Thilo Scharf, Donegal (IE)

(73) Assignees: DynaEnergetics GmbH & Co. KG, Troisdorf (DE); JDP Engineering and Machine Inc, Calgary (CA)

( * ) Notice: Subject to any disclaimer, the term of this patent is extended or adjusted under 35 U.S.C. 154(b) by 0 days.

(21) Appl. No.: 16/359,540

(22) Filed: Mar. 20, 2019

(65) Prior Publication Data

US 2019/0219375 A1 Jul. 18, 2019

Related U.S. Application Data

(60) Continuation of application No. 15/920,812, filed on Mar. 14, 2018, which is a continuation of application (Continued)

(30) Foreign Application Priority Data

Jul. 18, 2013 (CA) ..... 2821506

(51) Int. Cl.
*E21B 43/1185* (2006.01)
*F42D 1/02* (2006.01)

(Continued)

(52) U.S. Cl.
CPC ..... *E21B 43/1185* (2013.01); *E21B 43/119* (2013.01); *E21B 43/11855* (2013.01);

(Continued)

(58) Field of Classification Search
CPC ..... E21B 43/1185; E21B 43/11852; E21B 43/11855; E21B 43/117; F42D 1/041; F42D 1/043; F42D 1/045; F42C 19/06
See application file for complete search history.

(56) References Cited

U.S. PATENT DOCUMENTS 2,358,466 A 9/1944 Miller
2,889,775 A 6/1959 Owen (Continued)

FOREIGN PATENT DOCUMENTS

CA 2821506 A1 1/2015
CN 85107897 A 9/1986

(Continued)

OTHER PUBLICATIONS

Austin Powder Company, A—140 F & Block, Detonator & Block Assembly, 2 pgs.

(Continued)

*Primary Examiner* — Joshua T Semick
(74) *Attorney, Agent, or Firm* — Moyles IP, LLC

(57) ABSTRACT

Components for a perforation gun system are provided including combinations of components including a self-centralizing charge holder system and a bottom connector that can double as a spacer. Any number of spacers can be used with any number of holders for any desired specific metric or imperial shot density, phase and length gun system.

20 Claims, 18 Drawing Sheets

Related U.S. Application Data

No. 15/617,344, filed on Jun. 8, 2017, which is a division of application No. 15/287,309, filed on Oct. 6, 2016, now Pat. No. 9,702,680, which is a division of application No. 14/904,788, filed as application No. PCT/CA2014/050673 on Jul. 16, 2014, now Pat. No. 9,494,021.

(51) Int. Cl.
*F42D 1/04* (2006.01)
*F42C 19/06* (2006.01)
*E21B 43/119* (2006.01)

(52) U.S. Cl.
CPC ..... *F42C 19/06* (2013.01); *F42D 1/02* (2013.01); *F42D 1/04* (2013.01); *F42D 1/043* (2013.01)

(56) References Cited

U.S. PATENT DOCUMENTS

| | | | | |
|---|---|---|---|---|
| 3,170,400 | A | 2/1965 | Nelson | |
| 3,246,707 | A | 4/1966 | Bell | |
| 3,374,735 | A | 3/1968 | Moore | |
| 3,504,723 | A | 4/1970 | Cushman et al. | |
| 3,859,921 | A | 1/1975 | Stephenson | |
| 4,007,790 | A | 2/1977 | Henning | |
| 4,058,061 | A | 11/1977 | Mansur, Jr. et al. | |
| 4,182,216 | A | 1/1980 | DeCaro | |
| 4,491,185 | A | 1/1985 | McClure | |
| 4,496,008 | A | 1/1985 | Pottier et al. | |
| 4,574,892 | A | 3/1986 | Grigar et al. | |
| 4,598,775 | A | 7/1986 | Vann et al. | |
| 4,747,201 | A | 5/1988 | Donovan et al. | |
| 4,776,393 | A | 10/1988 | Forehand et al. | |
| 4,790,383 | A | 12/1988 | Savage et al. | |
| 4,889,183 | A | 12/1989 | Sommers et al. | |
| 5,027,708 | A * | 7/1991 | Gonzalez | E21B 43/1185 102/202.1 |
| 5,052,489 | A | 10/1991 | Carisella et al. | |
| 5,088,413 | A | 2/1992 | Huber | |
| 5,105,742 | A | 4/1992 | Sumner | |
| 5,159,145 | A | 10/1992 | Carisella et al. | |
| 5,322,019 | A | 6/1994 | Hyland | |
| 5,347,929 | A | 9/1994 | Lerche et al. | |
| 5,436,791 | A | 7/1995 | Turano et al. | |
| 5,703,319 | A | 12/1997 | Fritz et al. | |
| 5,775,426 | A | 7/1998 | Snider et al. | |
| 5,816,343 | A | 10/1998 | Markel et al. | |
| 6,006,833 | A | 12/1999 | Burleson et al. | |
| 6,012,525 | A | 1/2000 | Burleson et al. | |
| 6,085,659 | A | 7/2000 | Beukes et al. | |
| 6,112,666 | A | 9/2000 | Murray et al. | |
| 6,305,287 | B1 | 10/2001 | Capers et al. | |
| 6,354,374 | B1 | 3/2002 | Edwards et al. | |
| 6,418,853 | B1 | 7/2002 | Duguet et al. | |
| 6,651,747 | B2 | 11/2003 | Chen et al. | |
| 6,739,265 | B1 | 5/2004 | Badger et al. | |
| 6,742,602 | B2 | 6/2004 | Trotechaud | |
| 6,752,083 | B1 * | 6/2004 | Lerche | E21B 43/1185 102/202.5 |
| 7,107,908 | B2 * | 9/2006 | Forman | F42D 1/055 102/202.5 |
| 7,193,527 | B2 | 3/2007 | Hall | |
| 7,278,491 | B2 | 10/2007 | Scott | |
| 7,347,278 | B2 | 3/2008 | Lerche et al. | |
| 7,568,429 | B2 | 8/2009 | Hummel et al. | |
| 7,762,172 | B2 | 7/2010 | Li et al. | |
| 7,762,351 | B2 | 7/2010 | Vidal | |
| 7,778,006 | B2 | 8/2010 | Stewart et al. | |
| 7,810,430 | B2 | 10/2010 | Chan et al. | |
| 7,908,970 | B1 | 3/2011 | Jakaboski et al. | |
| 7,929,270 | B2 | 4/2011 | Hummel et al. | |
| 8,066,083 | B2 | 11/2011 | Hales et al. | |
| 8,069,789 | B2 | 12/2011 | Hummel et al. | |
| 8,074,737 | B2 | 12/2011 | Hill et al. | |
| 8,157,022 | B2 | 4/2012 | Bertoja et al. | |
| 8,181,718 | B2 | 5/2012 | Burleson et al. | |
| 8,182,212 | B2 | 5/2012 | Parcell | |
| 8,186,259 | B2 | 5/2012 | Burleson et al. | |
| 8,256,337 | B2 | 9/2012 | Hill | |
| 8,395,878 | B2 | 3/2013 | Stewart et al. | |
| 8,451,137 | B2 | 5/2013 | Bonavides et al. | |
| 8,695,506 | B2 * | 4/2014 | Lanclos | E21B 43/1185 102/206 |
| 8,875,787 | B2 | 11/2014 | Tassaroli | |
| 8,881,816 | B2 | 11/2014 | Glenn et al. | |
| 9,080,433 | B2 | 7/2015 | Lanclos et al. | |
| 9,175,553 | B2 * | 11/2015 | McCann | E21B 43/1185 |
| 9,194,219 | B1 * | 11/2015 | Hardesty | F42D 1/05 |
| 9,494,021 | B2 | 11/2016 | Parks et al. | |
| 9,518,454 | B2 * | 12/2016 | Current | E21B 43/11 |
| 9,581,422 | B2 | 2/2017 | Preiss et al. | |
| 9,605,937 | B2 | 3/2017 | Eitschberger et al. | |
| 9,677,363 | B2 * | 6/2017 | Schacherer | E21B 29/02 |
| 9,689,223 | B2 | 6/2017 | Schacherer et al. | |
| 9,822,618 | B2 * | 11/2017 | Eitschberger | E21B 43/1185 |
| 10,077,641 | B2 | 9/2018 | Rogman et al. | |
| 10,190,398 | B2 * | 1/2019 | Goodman | E21B 43/1185 |
| 2002/0020320 | A1 | 2/2002 | Lebaudy et al. | |
| 2002/0062991 | A1 | 5/2002 | Farrant et al. | |
| 2003/0000411 | A1 | 1/2003 | Cernocky et al. | |
| 2003/0001753 | A1 | 1/2003 | Cernocky et al. | |
| 2005/0178282 | A1 | 8/2005 | Brooks et al. | |
| 2005/0194146 | A1 | 9/2005 | Barker et al. | |
| 2007/0158071 | A1 | 7/2007 | Mooney et al. | |
| 2008/0149338 | A1 | 6/2008 | Goodman et al. | |
| 2008/0173204 | A1 | 7/2008 | Anderson et al. | |
| 2008/0264639 | A1 | 10/2008 | Parrott et al. | |
| 2009/0050322 | A1 | 2/2009 | Hill et al. | |
| 2010/0230104 | A1 | 9/2010 | Noelke et al. | |
| 2012/0199031 | A1 | 8/2012 | Lanclos | |
| 2012/0242135 | A1 | 9/2012 | Thomson et al. | |
| 2012/0247769 | A1 | 10/2012 | Schacherer et al. | |
| 2012/0247771 | A1 | 10/2012 | Black et al. | |
| 2012/0298361 | A1 | 11/2012 | Sampson | |
| 2013/0008639 | A1 | 1/2013 | Tassaroli | |
| 2013/0118342 | A1 | 5/2013 | Tassaroli | |
| 2015/0226044 | A1 | 8/2015 | Ursi et al. | |
| 2016/0061572 | A1 | 3/2016 | Eitschberger et al. | |
| 2016/0084048 | A1 | 3/2016 | Harrigan et al. | |
| 2016/0168961 | A1 | 6/2016 | Parks et al. | |
| 2017/0030693 | A1 | 2/2017 | Preiss et al. | |
| 2017/0211363 | A1 * | 7/2017 | Bradley | F42B 3/08 |

FOREIGN PATENT DOCUMENTS

| | | | |
|---|---|---|---|
| CN | 101397890 | A | 4/2009 |
| CN | 201620848 | U | 11/2010 |
| RU | 2633904 | C1 | 10/2017 |
| WO | 2001059401 | A1 | 8/2001 |
| WO | 2009091422 | A2 | 7/2009 |
| WO | 2015006869 | A1 | 1/2015 |
| WO | 2015134719 | A1 | 9/2015 |

OTHER PUBLICATIONS

Owen Oil Tools & Pacific Scientific; Side Block for Side Initiation, 1 pg.

SIPO, Office Action dated Jun. 27, 2018: See Office Action for CN App. No. 201580011132.7, which is in the same family as PCT App. No. PCT/US2015/18906, 9 pgs. & 5 pgs.

Amit Govil, Selective Perforation: A Game Changer in Perforating Technology—Case Study, presented at the 2012 European and West African Perforating Symposium, Schlumberger, Nov. 7-9. 2012, 14 pgs.

Dynaenergetics, DYNAselect System, information downloaded from website, Jul. 3, 2013, 2 pgs., http://www.dynaenergetics.com/.

GB Intellectual Property Office, Search Report for App. No. GB 1700625.5, which is in the same family as U.S. Pat. No. 9,494,021, dated Jul. 7, 2017, 5 pgs.

(56) References Cited

OTHER PUBLICATIONS

International Search Report and Written Opinion of International Application No. PCT/US2015/018906, dated Jul. 10, 2015, 12 pgs.
Dynaenergetics, Gun Assembly, Products Summary Sheet, May 7, 2004, 1 pg.
GB Intellectual Property Office, Office Action dated Feb. 27, 2018, See Office Action for App. No. GB 1717516.7, which is the same family as PCT App. No. PCT/CA2014/050673, 6 pg.
Dynaenergetics, Selective Perforating Switch, information downloaded from website, Jul. 3, 2013, 2 pgs.,http://www.dynaenergetics.com/.
Hunting Titan, Wireline Top Fire Detonator Systems, Product Information Sheet, 1 pg.
Hunting Titan Inc., Petition for Inter Parties Review of U.S. Pat. No. 9,581,422, filed Feb. 16, 2018, 93 pgs.
Dynaenergetics GmbH & Co. KG, Patent Owner's Response to Hunting Titan's Petition for Inter Parties Review, filed Dec. 6, 2018, 73 pgs.
Dynaenergetics GmbH & Co. KG, Patent Owner's Motion to Amend, filed Dec. 6, 2018, 53 pgs.
U.S. Patent Trial and Appeal Board, Institution of Inter Partes Review, Case IPR2018-00600, issued on Aug. 21, 2018, 9 pgs.
International Written Opinion of International Application No. PCT/CA2014/050673, dated Oct. 9, 2014, 4 pgs.
International Search Report of International Application No. PCT/CA2014/050673, dated Oct. 9, 2014, 3 pgs.
UK Examination Report of United Kingdom Patent Application No. GB1600085.3, which is in the same family as U.S. Pat. No. 9,494,021, dated Mar. 9, 2016, 1 pg.
FIIP, Search Report dated Feb. 1, 2018, in Russian: See Search Report for RU App. No. 2016104882/03, which is in the same family as PCT App. No. PCT/CA2014/050673, 7 pgs.
FIIP, Search Report dated Feb. 1, 2018, in English See Search Report for RU App. No. 2016104882/03, which is in the same family as PCT App. No. PCT/CA2014/050673, 4 pages.
Norwegan Industrial Property Office, Office Action for NO Patent App. No. 20160017, which is in the same family as PCT App No. PCT/CA2014/050673, dated Jun. 15, 2017, 3 pgs.
Jet Research Center Inc., Red RF Safe Detonators Brochure, 2008, 2 pgs., www.jetresearch.com.
Jet Research Center Inc., JRC Catalog, 36 pgs., www.jetresearch.com.
Horizontal Wireline Services, Presentation of a completion method of shale demonstrated through an example of Marcellus Shale, Pennsylvania, USA, Presented at 2012 International Perforating Symposium (Apr. 26-28, 2012), 17 pages.
Smylie, New Safe and Secure Detonators for the Industry's consideration, Presented at Explosives Safety & Security Conference Marathon Oil Co, Houston, Feb. 23-24, 2005, 20 pages.
Schlumberger, Combining and Customizing Technologies for Perforating Horizontal Wells in Algeria, Presented at 2011 MENAPS Middle East and North Africa Perforating Symposium, Nov. 28-30, 2011, 20 pages.
Baker Hughes, Long Gun Deployment Systems IPS-12-28, Presented at 2012 International Perforating Symposium, Apr. 26-28, 2011, 11 pages.
Owen Oil Tools, Recommended Practice for Oilfield Explosive Safety, Presented at 2011 Menaps Middle East and North Africa Perforating Symposium, Nov. 28-30, 2011, 6 pages.
Norwegan Industrial Property Office, Search Report for NO Patent App. No. 20160017, which is in the same family as PCT App No. PCT/CA2014/050673, dated Jun. 15, 2017, 2 pgs.
Dynaenergetics, Selection Perforating Switch, Product Information Sheet, May 27, 2011, 1 pg.
Dynaenergetics, Electronic Top Fire Detonator, Product Information Sheet, Jul. 30, 2013 1 pg.
German Patent Office, Office Action dated May 22, 2014, in German: See Office Action for German Patent Application No. 10 2013 109 227.6, which is in the same family as PCT Application No. PCT/EP2014/065752, 8 pgs.
PCT Search Report and Written Opinion, dated May 4, 2015: See Search Report and Written opinion for PCT Application No. PCT/EP2014/065752, 12 pgs.
SIPO, Search Report dated Mar. 29, 2017, in Chinese: See Search Report for CN App. No. 201480040456.9, which is in the same family as PCT App. No. PCT/CA2014/050673, 12 & 3 pgs.
Jim Gilliat/Kaled Gasmi, New Select-Fire System, Baker Hughes, Presentation—2013 Asia-Pacific Perforating Symposium, Apr. 29, 2013, 16 pgs., http://www.perforators.org/presentations.php.
Dynaenergetics, DYNAselect Electronic Detonator 0015 SFDE RDX 1.4S, Product Information, Dec. 16, 2011, 1 pg.
Dynaenergetics, DYNAselect Electronic Detonator 0015 SFDE RDX 1.4B, Product Information, Dec. 16, 2011, 1 pg.
Intellectual Property India, Office Action of in Application No. 201647004496, dated Jun. 7, 2019, which is in the same family as U.S. Appl. No. 16/359,540, 6 pgs.

* cited by examiner

FIG. 4
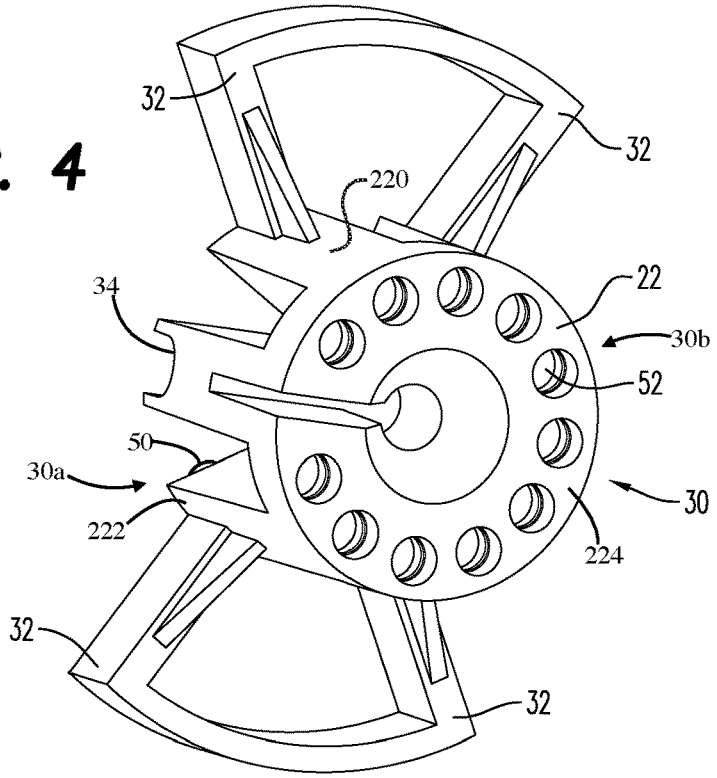
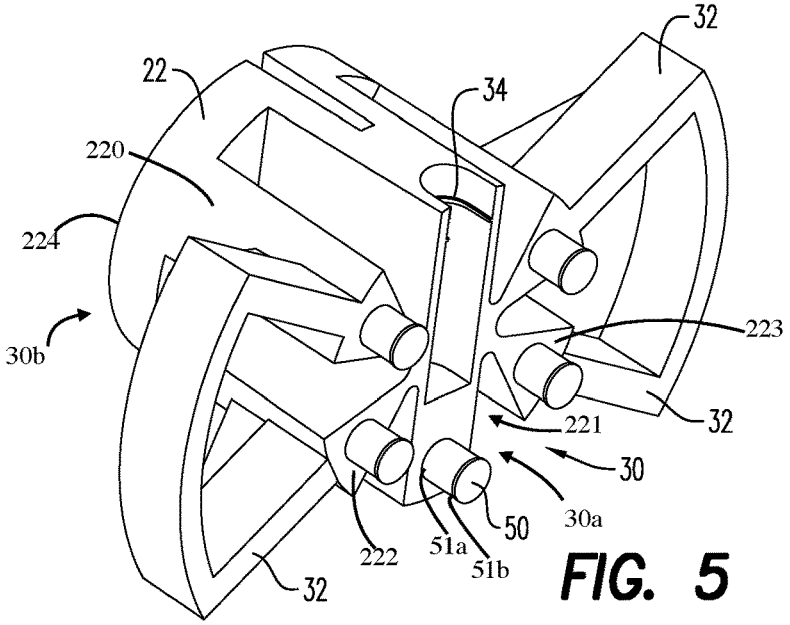
FIG. 5

FIG. 29
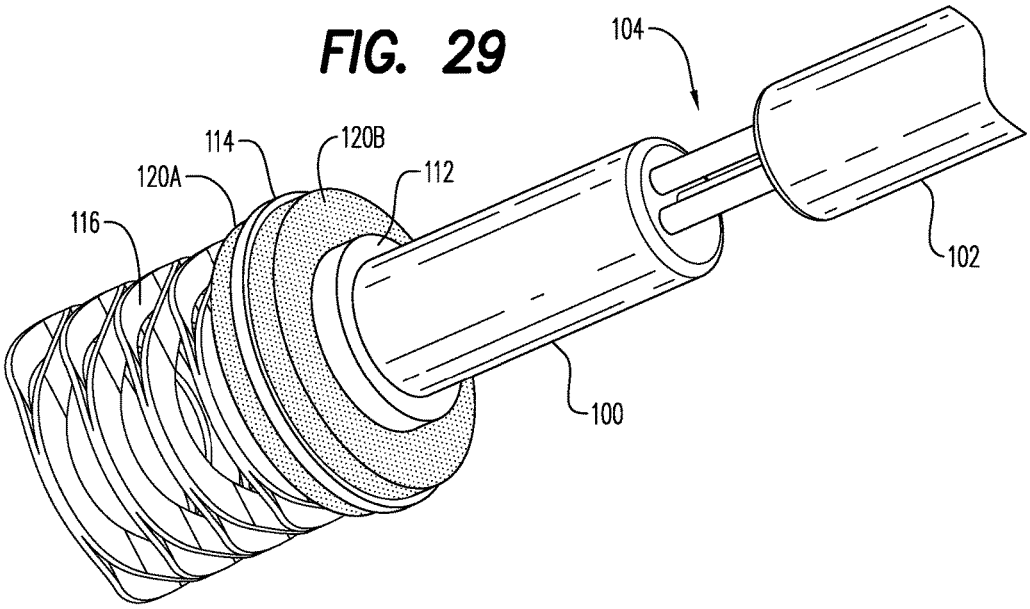
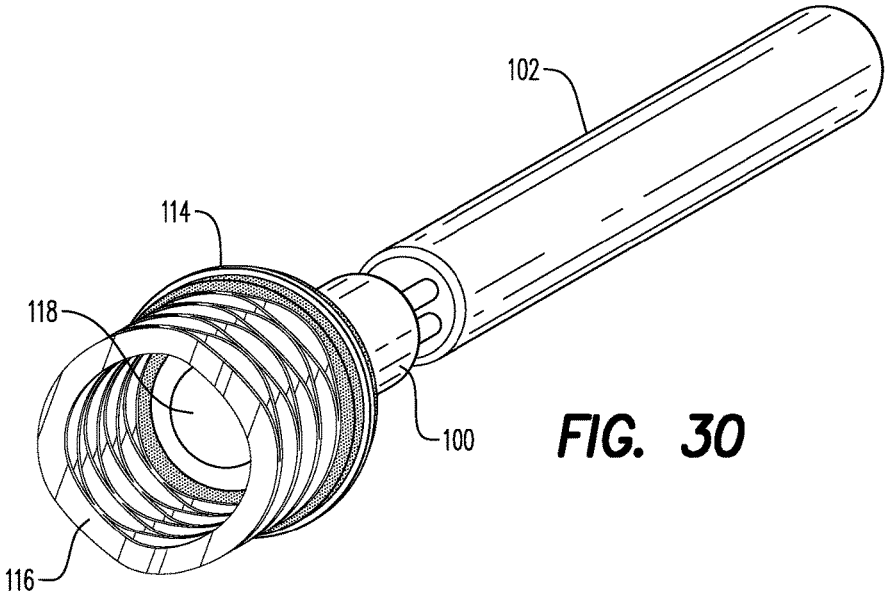
FIG. 30

PERFORATION GUN COMPONENTS AND SYSTEM

CROSS-REFERENCE TO RELATED APPLICATIONS

This application is a continuation of U.S. patent application Ser. No. 15/920,812 filed Mar. 14, 2018, which is a continuation of U.S. patent application Ser. No. 15/617,344 filed Jun. 8, 2017, which is a divisional patent application of U.S. patent application Ser. No. 15/287,309 filed Oct. 6, 2016, which is a divisional patent application of U.S. patent application Ser. No. 14/904,788 filed Jan. 13, 2016, which claims priority to PCT Application No. PCT/CA2014/050673 filed Jul. 16, 2014, which claims priority to Canadian Patent Application No. 2,821,506 filed Jul. 18, 2013, each of which is incorporated herein by reference in its entirety.

FIELD

A perforation gun system is generally described. More particularly, various perforation gun components that can be modularly assembled into a perforation gun system, the assembled perforated gun system itself, a perforation gun system kit, and a method for assembling a perforation gun system are generally described.

BACKGROUND

Perforation gun systems are used in well bore perforating in the oil and natural gas industries to tie a bore hole with a storage horizon within which a storage reservoir of oil or natural gas is located.

A typical perforation gun system consists of an outer gun carrier, arranged in the interior of which there are perforators-usually hollow or projectile charges—that shoot radially outwards through the gun carrier after detonation. Penetration holes remain in the gun carrier after the shot.

In order to initiate the perforators, there is a detonating cord leading through the gun carrier that is coupled to a detonator.

Different perforating scenarios often require different phasing and density of charges or gun lengths. Moreover, it is sometimes desirable that the perforators shooting radially outwards from the gun carrier be oriented in different directions along the length of the barrel. Therefore, phasing may be required between different guns along the length.

Onsite assembly of perforation gun systems may also be problematic under certain conditions as there are certain safety hazards inherent to the assembly of perforation guns due to the explosive nature of certain of its sub-components, including the detonator and the detonating cord.

There is thus a need for a perforation gun system, which by virtue of its design and components would be able to address at least one of the above-mentioned needs, or overcome or at least minimize at least one of the above-mentioned drawbacks.

SUMMARY

According to an embodiment, an object is to provide a perforation gun system that addresses at least one of the above-mentioned needs.

According to an embodiment, there is provided a perforation gun system having an outer gun carrier and comprising:

a top connector;

at least one stackable charge holder for centralizing a single shaped charge within the gun carrier;

a detonation cord connected to the top connector and to each stackable charge holder;

at least one bottom connector for terminating the detonation cord in the gun system; and a detonator energetically coupled to the detonation cord, wherein each of the top connector, at least one stackable charge holder and at least one bottom connector comprise a rotation coupling for providing a selectable clocking rotation between each of the top connector, at least one stackable charge holder and at least one bottom connector.

In some embodiments, the bottom connector may double as a spacer for spacing a plurality of stackable charge holders, and may either act as a metric dimensioned spacer or as an imperial dimensioned spacer for any specific metric or imperial shot density, phase and length gun system.

According to another aspect, there is also provided a perforation gun system kit having component parts capable of being assembled within an outer gun carrier, the kit comprising a combination of:

a top connector;

at least one stackable charge holder for centralizing a single shaped charge within the gun carrier;

a detonation cord connectable to the top connector and to each stackable charge holder;

at least one bottom connector adapted for terminating the detonation cord in the gun system; and a detonator energetically couplable to the detonation cord, wherein each of the top connector, at least one stackable charge holder and at least one bottom connector comprise a coupling having a plurality of rotational degrees of freedom for providing a selectable rotation between each of the top connector, at least one stackable charge holder and at least one bottom connector.

According to another aspect, there is also provided a method for assembling a perforation gun system, comprising the steps of:

providing a perforation gun system kit having component parts capable of being assembled within an outer gun carrier, the kit comprising a combination of:

a top connector;

at least one stackable charge holder for centralizing a single shaped charge within the gun carrier;

a detonation cord connectable to the top connector and to each stackable charge holder;

at least one bottom connector adapted for terminating the detonation cord in the gun system and adapted for doubling as a spacer for spacing a plurality of stackable charge holders; and a detonator energetically couplable to the detonation cord, wherein each of the top connector, at least one stackable charge holder and at least one bottom connector comprise a coupling having a plurality of rotational degrees of freedom for providing a selectable rotation between each of the top connector, at least one stackable charge holder and at least one bottom connector;

assembling a plurality of the stackable charge holders in a predetermined phase to form a first gun assembly;

running the detonation cord into a bottommost bottom connector;

assembling the bottommost bottom connector onto the assembled plurality of stackable charge holders;

running a through wire between the bottommost bottom connector and the top connector, so that the wire goes from the top connector to the bottom connector;

clicking the detonation cord into recesses formed in capturing projections, the captured projections being provided in each of the charge holders;

running the detonation cord into the top connector;

cutting the detonator cord; and installing charges into each of the charge holders.

A number of optional steps that are detailed below may be added to the above-described steps of the method.

According to another aspect, there is also provided a top connector for a perforation gun system comprising:

a coupler for providing energetic coupling between a detonator and a detonating cord;

at least one directional locking fin for locking the top connector within a gun carrier;

a rotation coupling for providing a selectable clocking rotation between the top connector, and a charge holder wherein the top connector is configured to receive electrical connections therethrough.

According to another aspect, there is also provided a stackable charge holder for a perforation gun system having an outer gun carrier, the charge holder comprising:

a charge receiving structure for receiving a single shaped charge;

a plurality of projections for centralizing the shaped charge within the gun carrier; and at least one rotation coupling for providing a selectable clocking rotation between the charge holder and an adjacent component in the perforation gun system;

wherein a pair of the plurality of projections is configured for capturing a detonation cord traversing the charge holder.

According to another aspect, there is also provided a bottom connector for a perforation gun system comprising:

a terminating structure arranged for terminating a detonation cord in the gun system;

a plurality of wings or fins for axially locking the bottom connector to a snap ring fixed in the carrier.

a rotation coupling for providing a selectable clocking rotation between the bottom connector and a charge holder; wherein the rotation coupling is arranged such that bottom connector doubles as a spacer for spacing a plurality of stackable charge holders.

BRIEF DESCRIPTION OF THE DRAWINGS

These and other objects and advantages will become apparent upon reading the detailed description and upon referring to specific embodiments thereof that are illustrated in the appended drawings. Understanding that these drawings depict only typical embodiments and are not therefore to be considered to be limiting of its scope, exemplary embodiments will be described and explained with additional specificity and detail through the use of the accompanying drawings in which:

FIG. 4 is a front perspective view of a bottom connector in accordance with an embodiment;

FIG. 5 is a rear perspective view of the bottom connector shown in FIG. 4;

FIG. 29 is another detailed perspective view of the detonator shown in FIG. 27;

FIG. 30 is another detailed perspective view of the detonator shown in FIG. 27;

DETAILED DESCRIPTION

In the following description and accompanying FIGS., the same numerical references refer to similar elements throughout the FIGS. and text. Furthermore, for the sake of simplicity and clarity, namely so as not to unduly burden the FIGS. with several reference numbers, only certain FIGS. have been provided with reference numbers, and components and features of the embodiments illustrated in other FIGS. can be easily inferred therefrom. The embodiments, geometrical configurations, and/or dimensions shown in the FIGS. are for exemplification purposes only. Various features, aspects and advantages of the embodiments will become more apparent from the following detailed description.

Moreover, although some of the embodiments were primarily designed for well bore perforating, for example, they may also be used in other perforating scenarios or in other fields, as apparent to a person skilled in the art. For this reason, expressions such as "gun system", etc., as used herein should not be taken as to be limiting, and includes all other kinds of materials, objects and/or purposes with which the various embodiments could be used and may be useful. Each example or embodiment are provided by way of explanation, and is not meant as a limitation and does not constitute a definition of all possible embodiments.

In addition, although some of the embodiments are illustrated in the accompanying drawings comprise various components and although the embodiment of the adjustment system as shown consists of certain geometrical configurations as explained and illustrated herein, not all of these components and geometries are essential and thus should not be taken in their restrictive sense, i.e. should not be taken as to limit the scope. It is to be understood, as also apparent to a person skilled in the art, that other suitable components and cooperations thereinbetween, as well as other suitable geometrical configurations may be used for the adjustment systems, and corresponding parts, according to various embodiments, as briefly explained and as can easily be inferred herefrom by a person skilled in the art, without departing from the scope.

Figure 1:
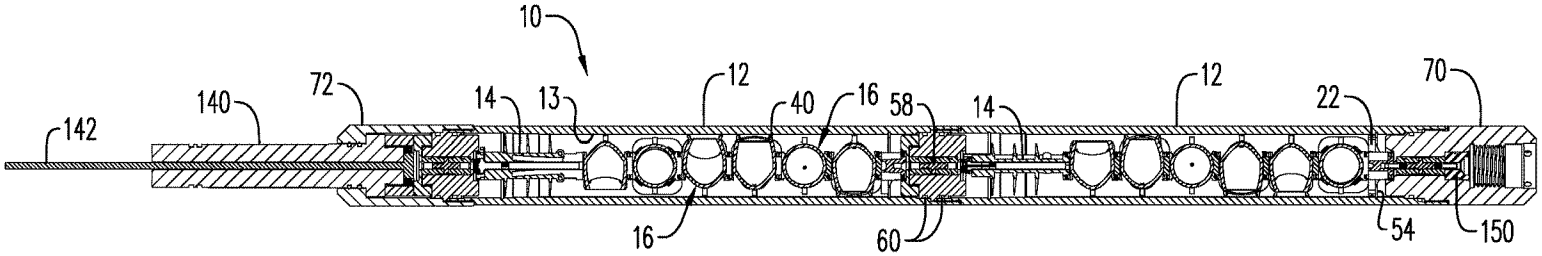
FIG. 1 is a side cut view of a perforation gun system according to an embodiment.
Figure 2:
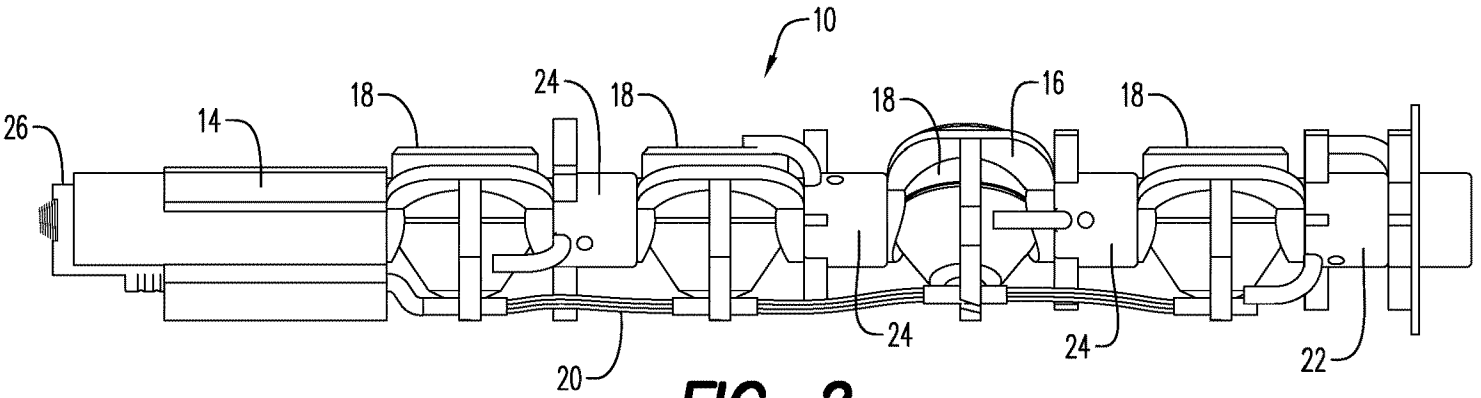
FIG. 2 is a side view of a top connector, bottom connector and stackable charge holders of a perforation gun system in accordance with another embodiment.
Figure 3:
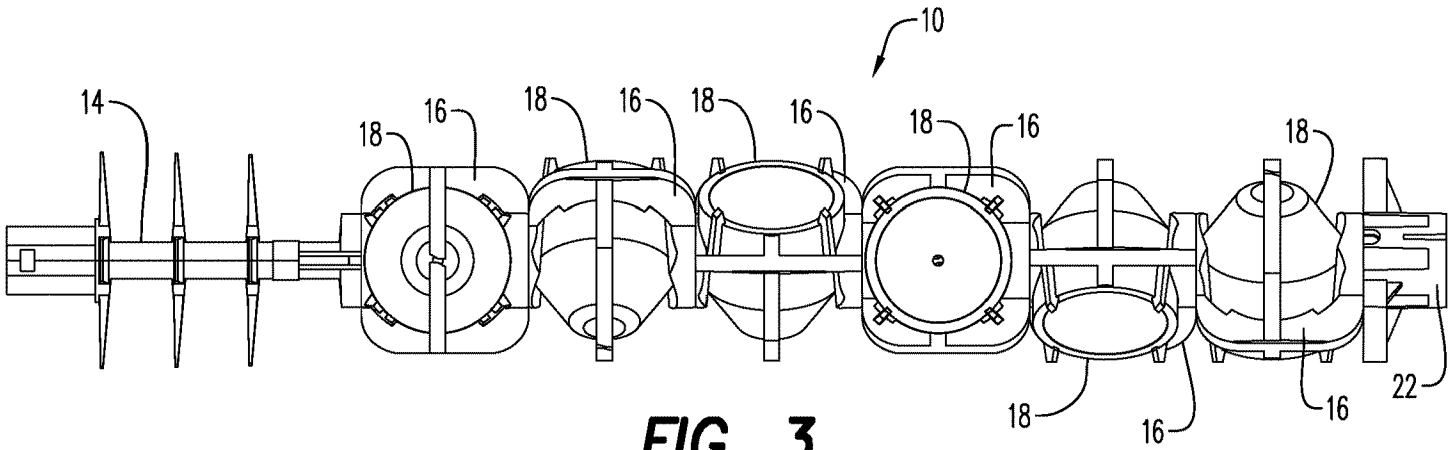
FIG. 3 is a side view of a top connector, bottom connector and stackable charge holders of a perforation gun system in accordance with another embodiment.
Figure 6:
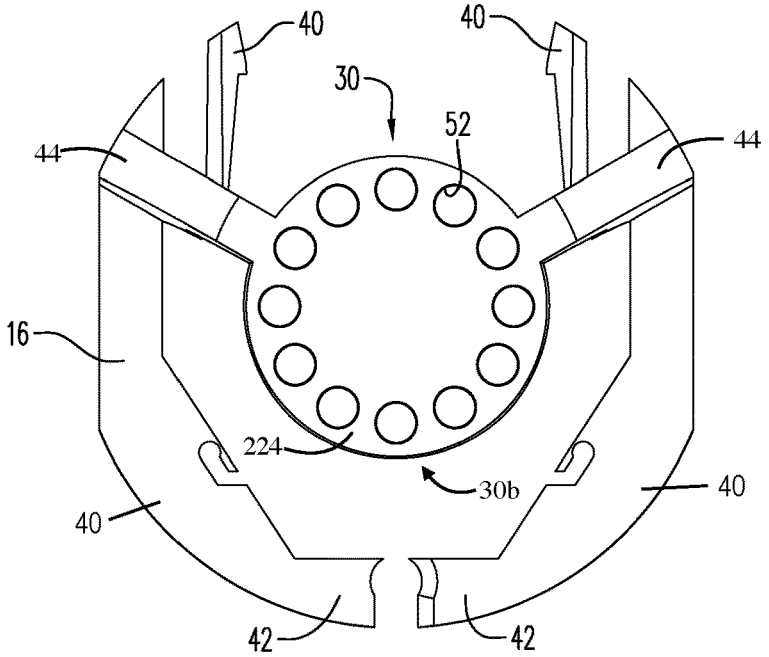
FIG. 6 is a front view of a stackable charge holder in accordance with an embodiment.
Figure 7:
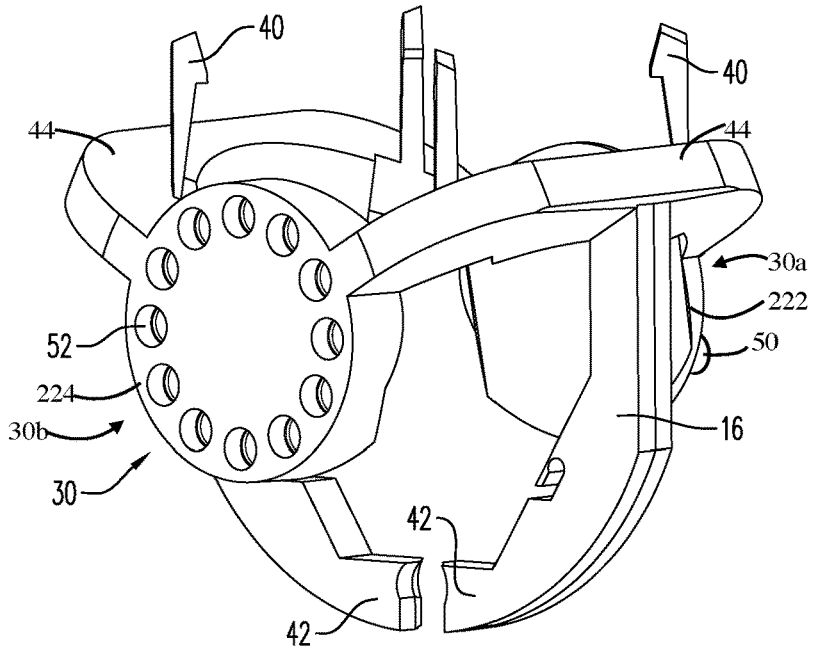
FIG. 7 is a front perspective view of the stackable charge holder shown in FIG. 6.
Figure 8:
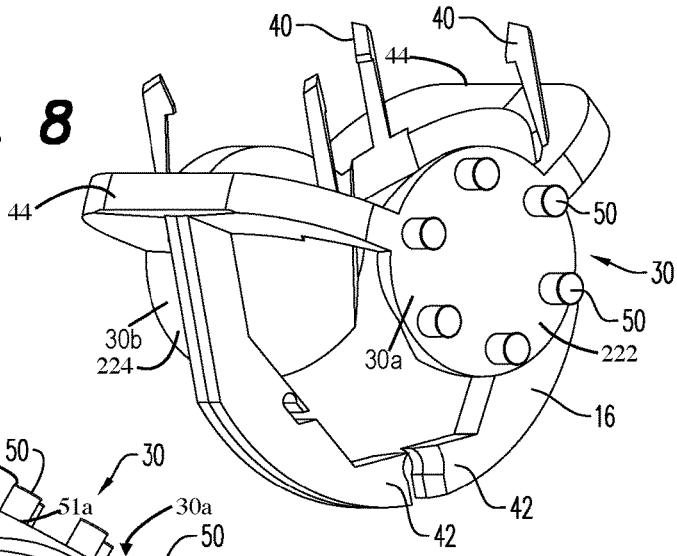
FIG. 8 is a rear perspective view of the stackable charge holder shown in FIG. 6.
Figure 9:
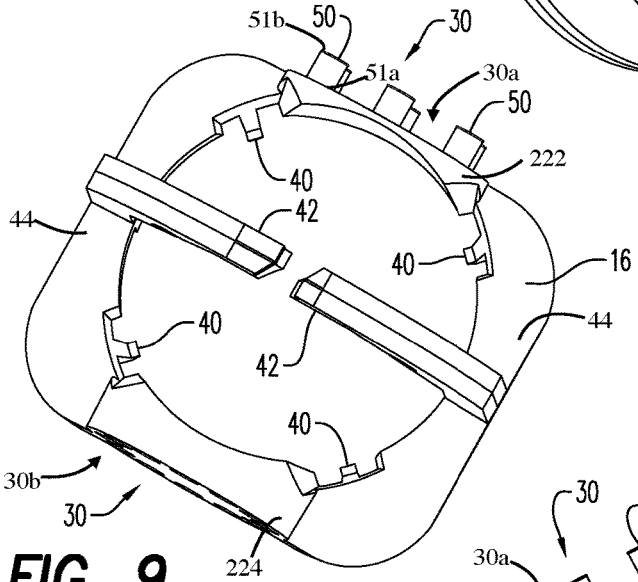
FIG. 9 is a bottom view of the stackable charge holder shown in FIG. 6.
Figure 10:
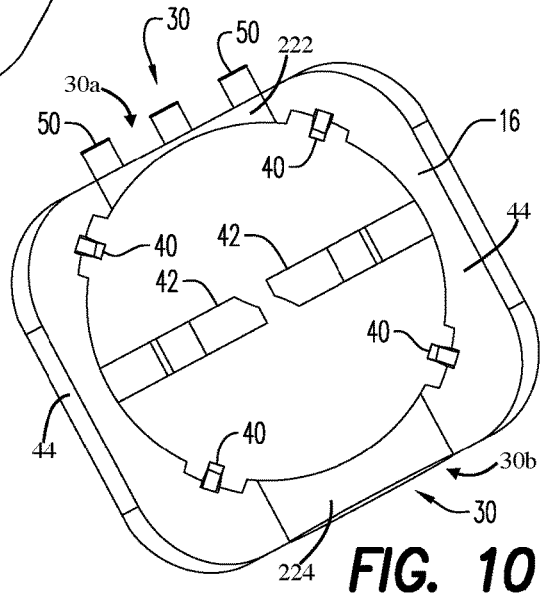
FIG. 10 is a top view of the stackable charge holder shown in FIG. 6.

Referring to FIGS. 1 to 3, an object is to provide a perforation gun system 10 having an outer gun carrier 12. The gun system 10 includes a top connector 14. At least one stackable charge holder 16 is provided for centralizing a single shaped charge 18 within the gun carrier 12. A detonation cord 20 is connected to the top connector 14 and to each stackable charge holder 16.

The gun system 10 includes at least one bottom connector 22 for terminating the detonation cord 20 in the gun system. As better shown in FIG. 2, it is also possible that the bottom connector 22 double as or serve the function of a spacer 24 for spacing a plurality of stackable charge holders 16.

In an embodiment, the gun system also includes a detonator 26 energetically coupled to the detonation cord 20.

As better shown in FIGS. 4 to 18, each of the top connector 14, stackable charge holder 16 and bottom connector 22 includes a rotation coupling 30 for providing a selectable clocking rotation between each of the above-mentioned components. As seen, for instance, in FIGS. 4-5 and 7-9, the rotation coupling 30 includes a first rotation coupling 30*a* and a second rotation coupling 30*b*.

Hence, a user can build multiple configurations of gun systems using various combinations of basic components. A first of these basic components includes a top connector. Another basic component is a single charge holder that centralizes a single shaped charge. The holder is adapted to be stacked and configured into 0, 30, 60, up to 360 degrees or any other combination of these phases for any specified length. Another basic component is a bottom connector that terminates the detonation cord in the gun. The bottom connector may carry as well an electrical connection therethrough. The bottom connector may also double as an imperial measurement stackable spacer to provide any gun shot density up to, for example, 6 shots per foot. Alternately, another bottom connector may be provided or configured to double as a metric measurement stackable spacer to provide any gun shot density up to, for example, 20 shots per meter. Another basic component includes a push-in detonator that does not use wires to make necessary connections. The push-in detonator may uses spring-loaded connectors, thus replacing any required wires and crimping.

Therefore, within the self-centralizing charge holder system, any number of spacers can be used with any number of holders for any specific metric or imperial shot density, phase and length gun system.

In an embodiment, only two pipe wrenches are required for assembly on site of the gun system, as no other tools are required.

In an embodiment, the top connector 14 provides energetic coupling between the detonator and detonating cord.

In an embodiment, each of the top connector 14, stackable charge holder 16 and bottom connector 22 are configured to receive electrical connections therethrough.

In an embodiment, all connections are made by connectors, such as spring-loaded connectors, instead of wires, with the exception of the through wire that goes from the top connector 14 to the bottom connector 22, whose ends are connectors.

In an embodiment, components of the assembly may include molded parts, which may also be manufactured to house the wiring integrally, through, for instance, overmolding, to encase the wiring and all connectors within an injection molded part. For example, the charge holder 16 could be overmolded to include the through wire.

Figure 19:
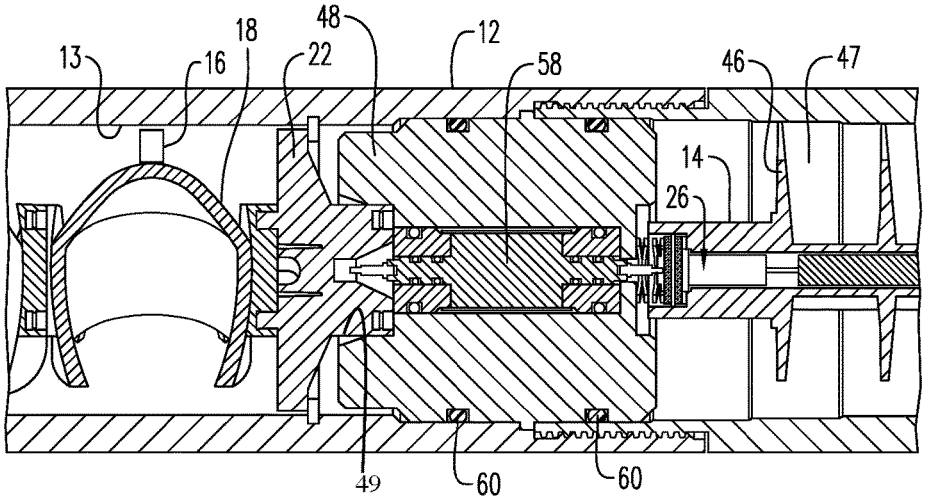
FIG. 19 is an enlarged detailed side cut view of a portion of the perforation gun system including a bulkhead and stackable charge holders shown in FIG. 1.

In an embodiment, and as shown in FIGS. 4 and 5, each bottom connector 22 includes a cylindrical body 220 comprising a first base 222 and a second base 224. The pins 50 outwardly extend from the first base 222, and the sockets 52 at least partially extend into the second base 224. As illustrated in FIGS. 4 and 5, each socket 52 is spaced apart from an adjacent socket and each pin 50 is spaced apart from an adjacent pin. The cylindrical body 220 may include a plurality of alternating v-shaped channels 221 and v-shaped walls 223. The v-shaped channels partially extend from the first base 222 towards the second base 224, and the v-shaped walls 223 extend from the second base 224 to the first base 222. At least one of the pins 50 of the rotation coupling 30 extend from one of the v-shaped walls 223. According to an aspect, when the bottom connector includes the first rotation coupling 30*a* and the second rotation coupling 30*b*, the cylindrical body 220 extends therebetween. The bottom connector 22 includes a plurality of fins/wings 32 radially extending from the body 220. The wings 32 are configured for axially locking each bottom connector against a snap ring 54, or an equivalent retainment mechanism to keep the charge holder 16 from sliding out of the bottom of carrier 12 as it is handled, (shown on FIG. 1). According to an aspect, and as illustrated in FIG. 19, the bottom connector 22 may be recessed into a recess 49 formed in the tandem seal adapter 48. The bottom connector 22 from a first gun assembly can accommodate or house an electrical connection through a bulkhead assembly 58 to the top connector 14 of a second or subsequent gun assembly, as seen for instance in FIG. 19. The top and bottom connector, as well as the spacer, in an embodiment, are made of 15% glass fiber reinforced, injection molding PA6 grade material, commercially available from BASF under its ULTRAMID® brand, and can provide a positive snap connection for any configuration or reconfiguration. As better shown in FIG. 5, a terminating means structure 34 is provided to facilitate terminating of the detonation cord. The structure 34 may be formed in the first base 222. The snap ring 54 is preinstalled on the bottom of the carrier 12. The assembly can thus shoulder up to the snap ring 54 via the bottom connector fins 32.

In an embodiment and as shown in FIGS. 6 to 10, each stackable charge holder 16 includes a charge receiving structure for receiving a single shaped charge, and a plurality of projections 40 extending from the charge receiving structure. The projections 40 may rest against an inner surface 13 or diameter of the gun carrier 12 (as shown in FIG. 1) and thereby centralizing the shaped charge therewithin. The charge receiving structure may include a pair of arms 44, and each projection 40 may extend from at least one of the arms 44. A pair 42 of the plurality of projections 40 may also be configured for capturing the detonation cord (not shown) traversing each stackable charge holder 16. The pair 42 of the plurality of projections are also used for centralizing the shaped charge within an inner surface of the gun carrier. According to an aspect, the stackable charge holder 15 includes a first base 222 and a second base 224 spaced apart from the first base 222. The arms 44 extend between the first and second bases 222, 224. According to an aspect, the pins 50 outwardly extend from the first base 222, and the sockets 52 at least partially extend into the second base 224. Each pin is spaced apart from an adjacent pin, and each socket 52 is spaced apart from an adjacent socket.

Figure 11:
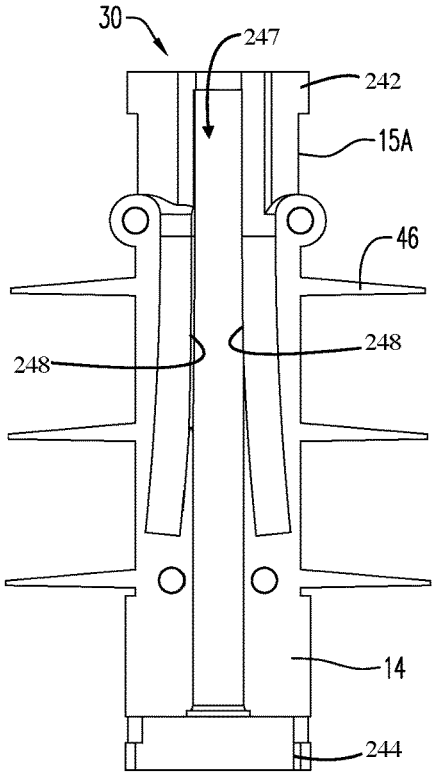
FIG. 11 is a bottom view of a half-portion of a top connector in accordance with an embodiment.
Figure 12:
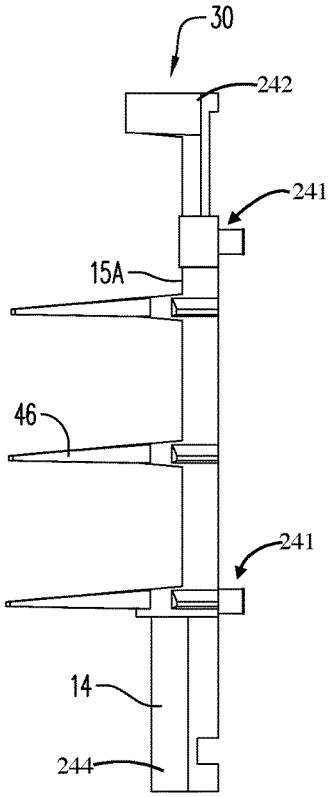
FIG. 12 is a side view of the half-portion of the top connector shown in FIG. 11.
Figure 13:
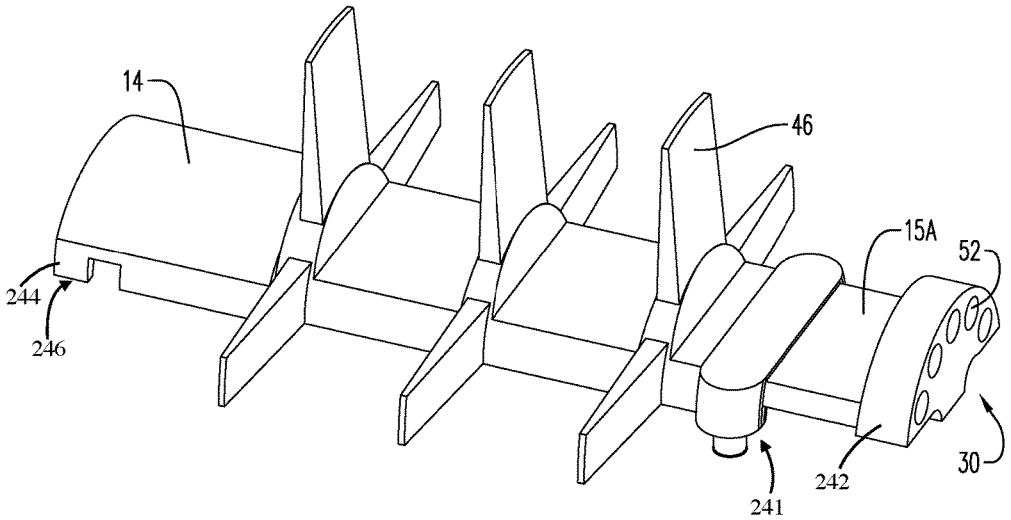
FIG. 13 is a top perspective view of the half-portion of the top connector shown in FIG. 11.
Figure 14:
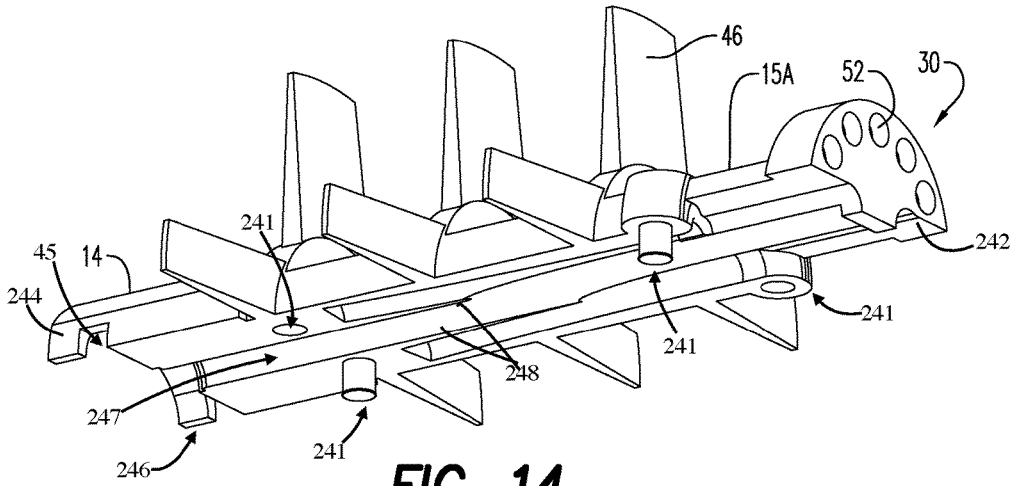
FIG. 14 is a bottom perspective view of the half-portion of the top connector shown in FIG. 11.
Figure 15:
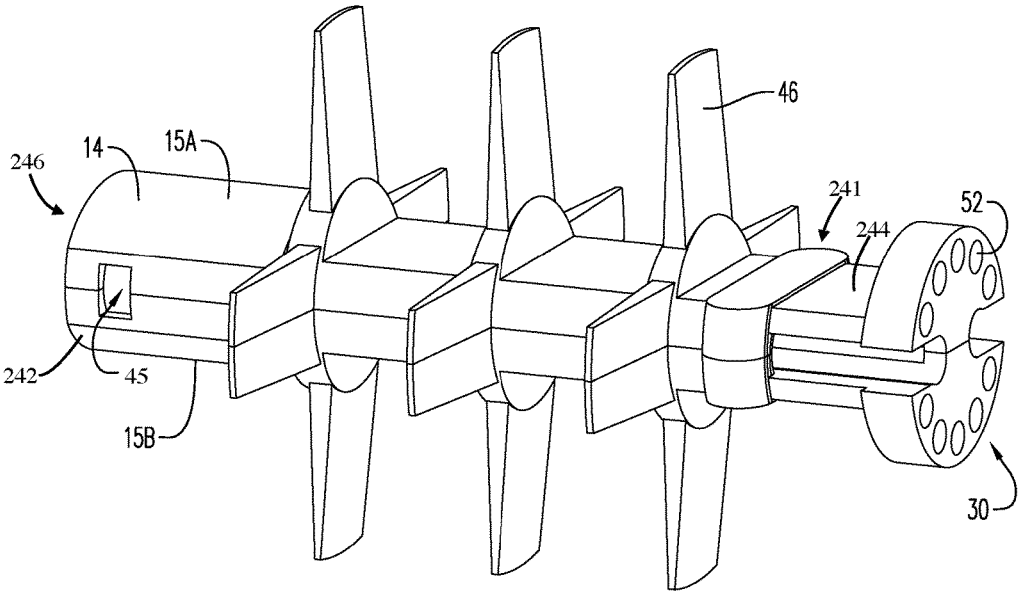
FIG. 15 is a perspective view of a top connector in accordance with an embodiment.
Figure 16:
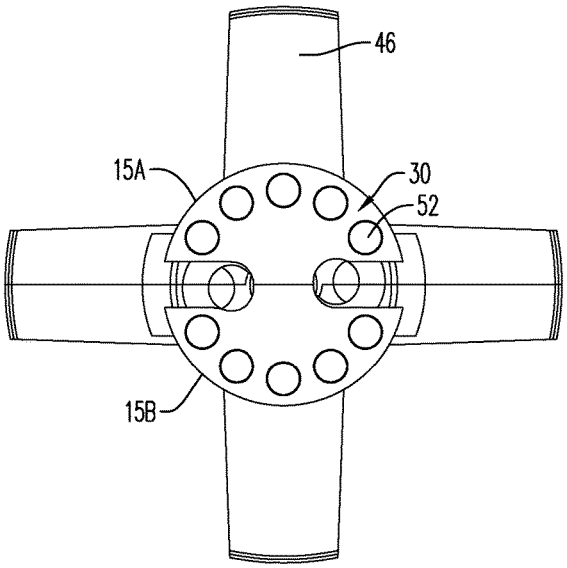
FIG. 16 is a front end view of the top connector shown in FIG. 15.
Figure 17:
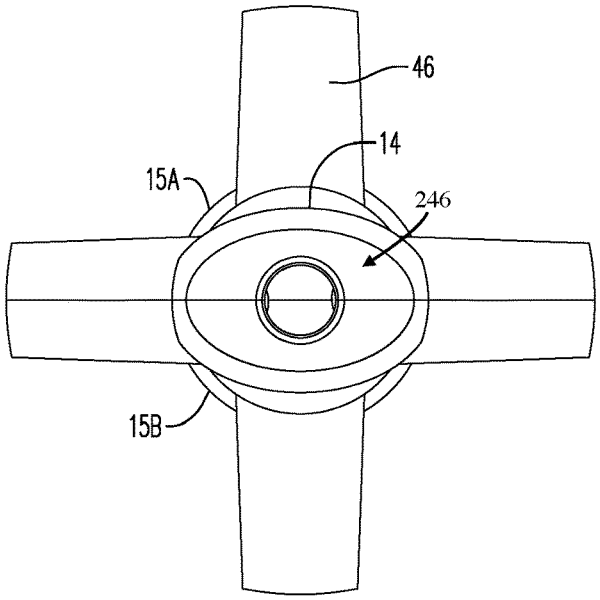
FIG. 17 is a rear end view of the top connector shown in FIG. 15.
Figure 18:
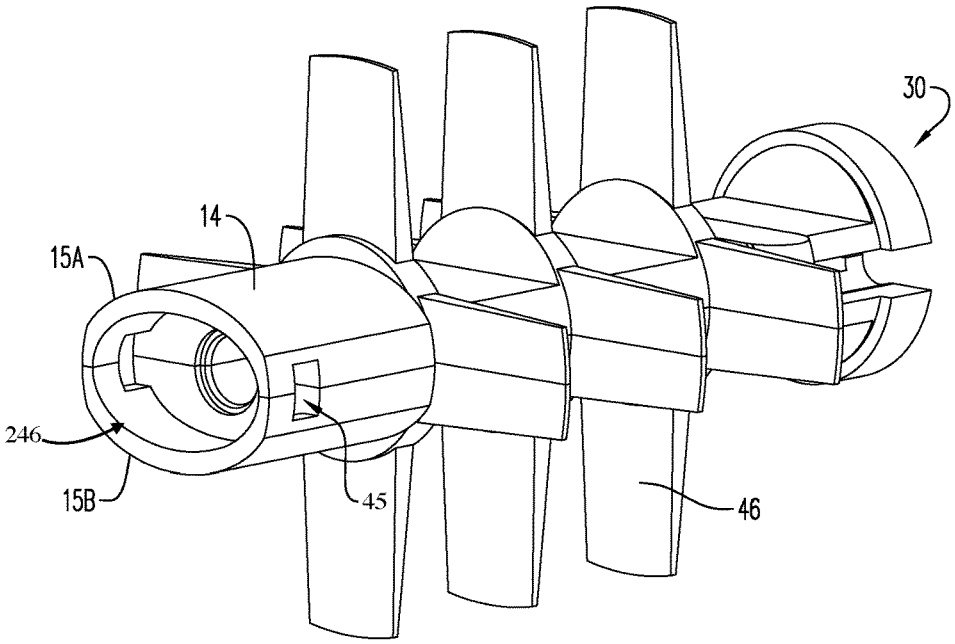
FIG. 18 is a rear perspective view of the top connector shown in FIG. 15.

In an embodiment, as shown in FIGS. 11 to 18, the top connector 14 includes a first end 242, a second end 244, and a coupler 246 formed at the first end 242. The top connector 14 may be configured for providing energetic coupling between the detonator 26 and a detonation cord. According to an aspect and as illustrated in FIGS. 11 and 14, an elongated opening 247 extends from the second end 244, adjacent the coupler 246, towards the first end 242. The elongated opening 247 is flanked by side walls 248 that provide the energetic coupling between the detonator 26 and the detonation cord 20. A rotation coupling 30 is formed at the second end 244. The rotation coupling includes at least one of a plurality of pins 50 and a plurality of sockets 52. According to an aspect, the top connector 14 includes at least one directional locking fin 46. Although the use of directional locking fins is described, other methods of directional locking may be used, in order to eliminate a top snap ring that would otherwise be used to lock the assembly. As better shown in FIG. 19, the locking fins 46 are engageable with corresponding complementarily-shaped structures 47 housed within the carrier 12, upon a rotation of the top connector 14, to lock the position of the top connector along the length of the carrier 12.

In an embodiment, as better shown in FIG. 19, the bottom connector 22 on one end and the top connector 14 on the other end abuts/connects to the bulkhead assembly 58. The tandem seal adapter 48 is configured to seal the inner components within the carrier 12 from the outside environment, using sealing means 60 (shown herein as o-rings). Thus, the tandem seal adapter 48 seals the gun assemblies from each other along with the bulkhead 58, and transmits a ground wire to the carrier 12. Hence, the top connector 14 and bulkhead 58 accommodate electrical and ballistic transfer to the charges of the next gun assembly for as many gun assembly units as required, each gun assembly unit having all the components of a gun assembly.

In an embodiment, the tandem seal adapter 48 is a two-part tandem seal adapter (not shown) that fully contains the bulkhead assembly 58 (comprised of multiple small parts as shown, for instance, in FIG. 19) and that is reversible such that it has no direction of installation.

In an embodiment and as better shown in FIGS. 27-31 and 35A, the detonator assembly 26 includes a detonator head 100, a detonator body 102 and a plurality of detonator wires 104, including a through wire 106, a signal-in wire 108 and a ground wire 110. The through wire 106 traverses from the top to the bottom of the perforating gun system 10, making a connection at each charge holder 16. The detonator head 100 further includes a through wire connector element 112 connected to the through wire 106 (not shown), a ground contact element 114 for connecting the ground wire 110 to the tandem seal adapter (also not shown), through ground springs 116, and a bulkhead connector element 118 for connecting the signal-in wire 108 to the bulkhead assembly 58 (also not shown). Different insulating elements 120A, 120B are also provided in the detonator head 100 for the purpose of insulating the detonator head 100 and detonator wires 104 from surrounding components. As better shown in FIG. 31, a crimp sleeve 122 can be provided to cover the detonator head 100 and body 102, thus resulting in a more robust assembly. The above configuration allows the detonator to be installed with minimal tooling and wire connections.

Figure 32:
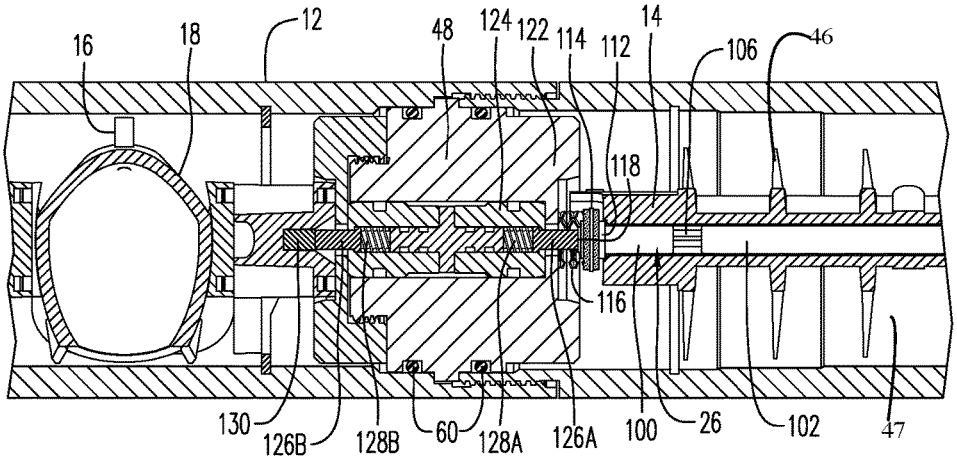
FIG. 32 is a detailed side view of a tandem seal adapter and detonator in accordance with another embodiment.
Figure 33:
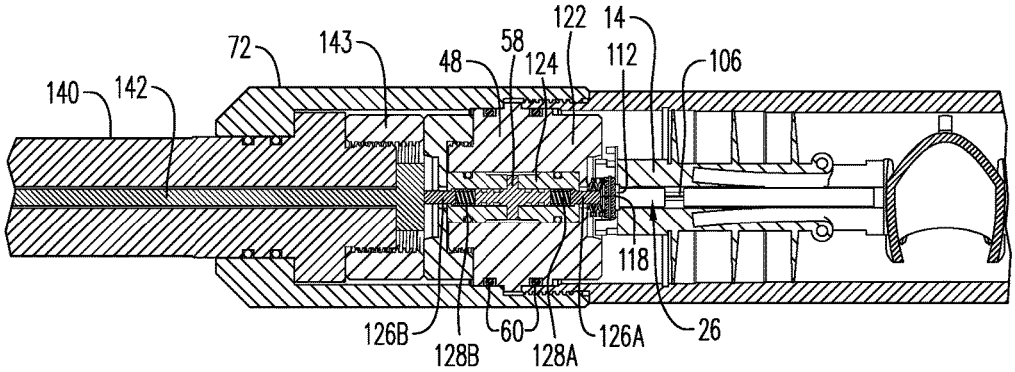
FIG. 33 is a side cut view of a portion of a perforation gun system illustrating the configuration of the top sub in accordance with another embodiment.
Figure 35A:
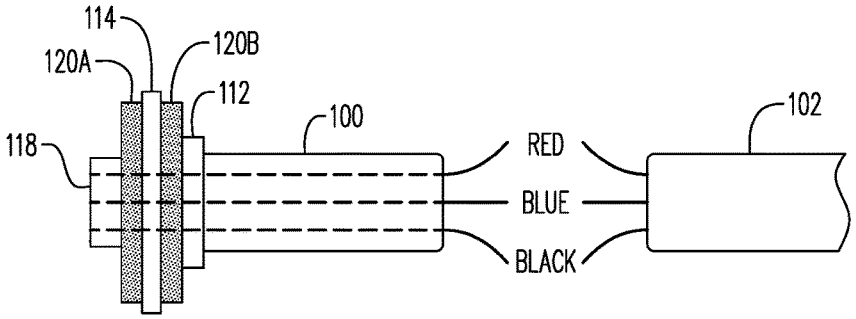
FIGS. 35A and 35B are electrical schematic views of a detonator and of wiring within a perforated gun system in accordance with another embodiment.
Figure 35B:
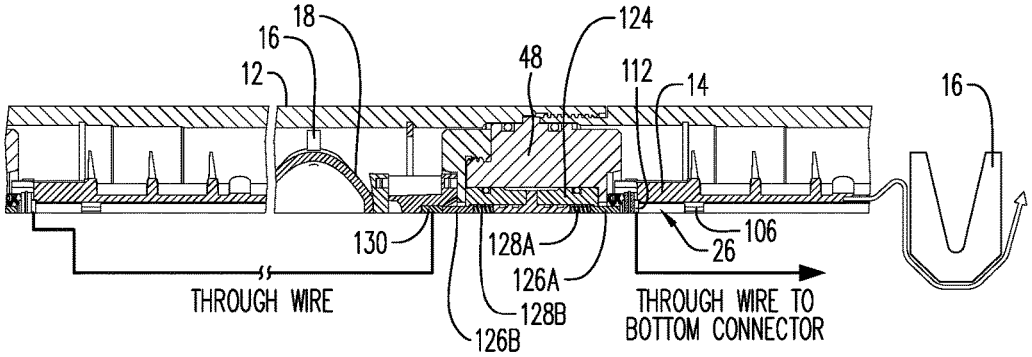

In an embodiment as shown in FIGS. 32, 33 and 35B illustrate a connection of the above-described detonator assembly 26 to the tandem seal adapter 48 and a pressure bulkhead 124. The bulkhead 124 includes spring connector end interfaces comprising contact pins 126A, 126B, linked to coil springs 128A, 128B. This dual spring pin connector assembly including the bulkhead 124 and coil springs 128A, 128B is positioned within the tandem seal adapter 48 extending from a conductor slug 130 to the bulkhead connector element. The dual spring pin connector assembly is connected to the through wire 106 of the detonator assembly 26.

In an embodiment and as better shown in FIGS. 11 to 18, the top connector 14 may have a split design to simplify manufacturing and aid in assembly. By "split design" what is meant is that the top connector 14 can be formed of two halves—a top half 15A and a bottom half 15B. A plurality of securing mechanisms 241 may be provided to couple the top half 15A to the bottom half 15B. As better shown in FIG. 15 or 18, the top connector 14 may also include a blind hole 45 to contain or house the detonation cord, thus eliminating the need for crimping the detonation cord during assembly.

In an embodiment and as shown for example in FIGS. 4 to 18, the rotation coupling 30 may either include a plurality of pins 50 (FIG. 5) symmetrically arranged about a central axis of the rotation coupling 30, or a plurality of sockets 52 (FIG. 4) symmetrically arranged about the central axis of the rotation coupling 30 and configured to engage the plurality of pins 50 of an adjacent rotation coupling 30. The pins each include a first end 51*a*, and a second end 51*b* opposite the first end 51*a*. According to an aspect, the second end 51*b* is wider than the first end 51*a*.

In another embodiment, the rotation coupling 30 may either include a polygon-shaped protrusion, or a polygon-shaped recess configured to engage the polygon-shaped protrusion of an adjacent rotation coupling. The polygon can be 12-sided for example for 30 degree increments.

In another embodiment, the top and bottom subs work with off the shelf running/setting tools as would be understood by one of ordinary skill in the art.

In one embodiment and as shown in FIG. 33, the top sub 72 facilitates use of an off the shelf quick change assembly 140 to enable electrical signals from the surface, as well as to adapt perforating gun system to mechanically run with conventional downhole equipment. The quick change assembly 140 may include a threaded adapter 143 to set an offset distance between an electrical connector 142 and the contact pin 126B extending from the bulkhead assembly 58.

Figure 34:
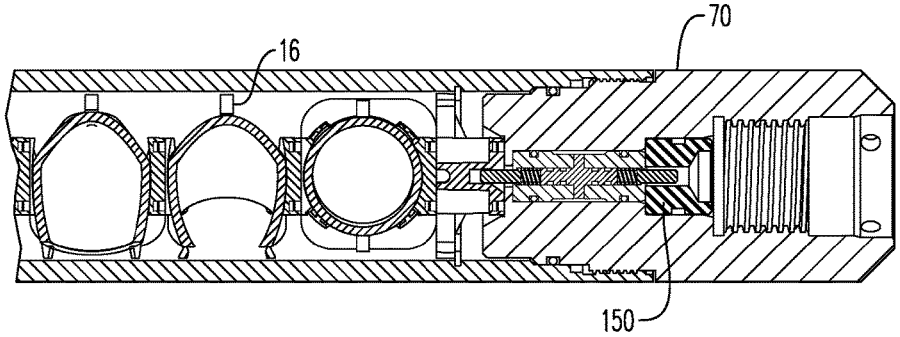
FIG. 34 is a side cut view of a portion of a perforation gun system illustrating the configuration of the bottom sub in accordance with another embodiment.

In one embodiment and as shown in FIG. 34, the bottom sub 70 may be configured as a sealing plug shoot adapter (SPSA) to be used specifically with this embodiment. The SPSA may receive an off the shelf quick change assembly 140 (not shown) and insulator 150 that communicates with a firing head threaded below it (not shown). A setting tool (not shown) may run on the bottom side of the perforating gun.

In an embodiment, final assembly of the tool string requires only two pipe wrenches. No tools are required to install the detonator or any electrical connections.

An object is to also provide a perforation gun system kit having the basic component parts described above and capable of being assembled within an outer gun carrier.

Figure 21:
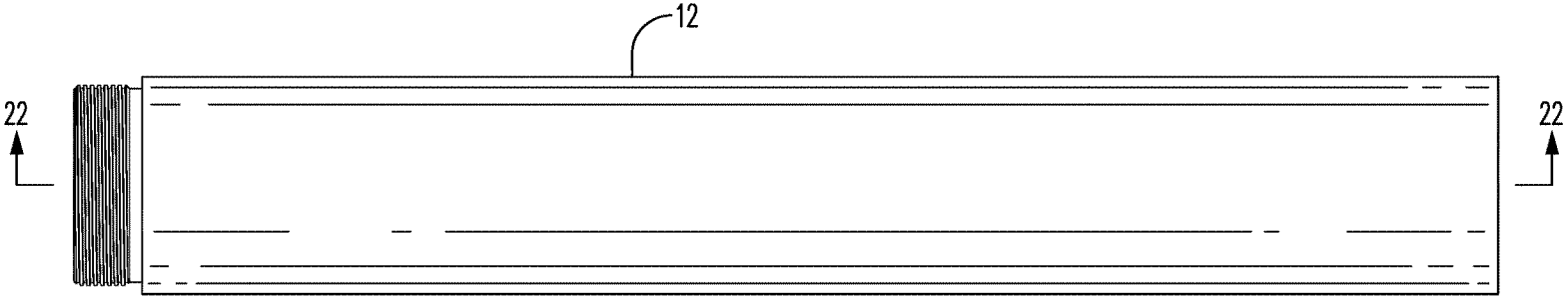
FIG. 21 is a side view of a gun carrier of a gun system in accordance with an embodiment.
Figure 22:
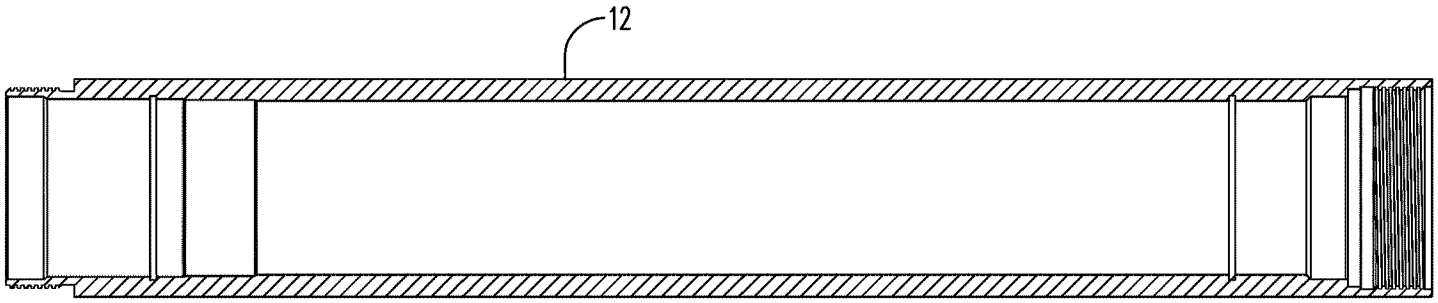
FIG. 22 is a side cut view of the gun carrier shown in FIG. 21.

In an embodiment, a method for assembling a perforation gun system is provided, to which a certain number of optional steps may be provided. The steps for assembling the gun system for transport include the steps of:

providing a perforation gun system kit having component parts capable of being assembled within an outer gun carrier (element 12 in FIGS. 1, 21 and 22), the kit comprising a combination of:

a top connector;

at least one stackable charge holder for centralizing a single shaped charge within the gun carrier;

a detonation cord connectable to the top connector and to each stackable charge holder;

at least one bottom connector adapted for terminating the detonation cord in the gun system and adapted for doubling as a spacer for spacing a plurality of stackable charge holders; and a detonator energetically couplable to the detonation cord, wherein each of the top connector, at least one stackable charge holder and at least one bottom connector comprise a coupling having a plurality of rotational degrees of freedom for providing a selectable rotation between each of the top connector, at least one stackable charge holder and at least one bottom connector;

assembling a plurality of the stackable charge holders in a predetermined phase to form a first gun assembly;

running the detonation cord into a bottommost bottom connector;

assembling the bottommost bottom connector onto the assembled plurality of stackable charge holders;

running a through wire between the bottommost bottom connector and the top connector, so that the through wire goes from the top connector to the bottom connector;

clicking the detonation cord into recesses formed in capturing projections, the capturing projections being provided in each of the charge holders;

running the detonation cord into the top connector;

cutting the detonator cord, if the detonator cord is not precut a predetermined length; and installing charges into each of the charge holders.

In an embodiment, the method further includes, prior to transport, the steps of: pushing assembled components together to engage all pin connections therebetween; and carrying out a continuity test to ensure complete connectivity of the detonating chord.

Figure 20:
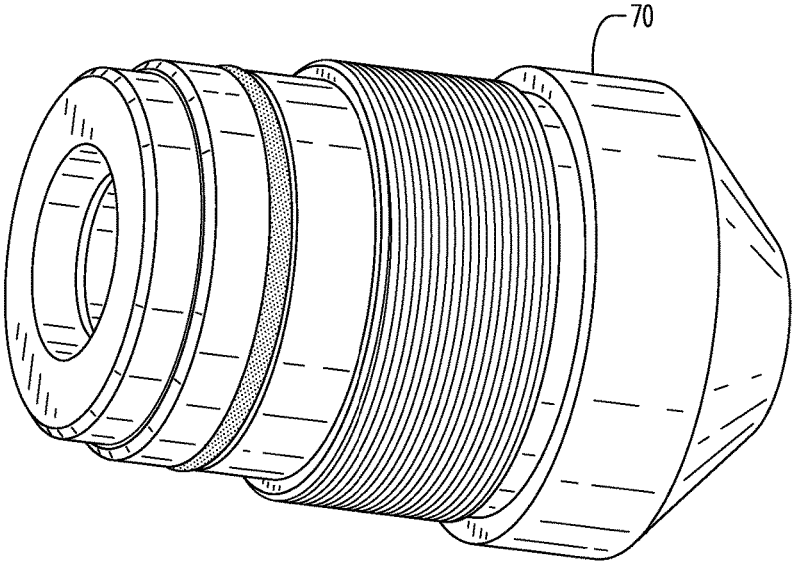
FIG. 20 is a perspective view of a bottom sub of a gun system in accordance with an embodiment.
Figure 23:
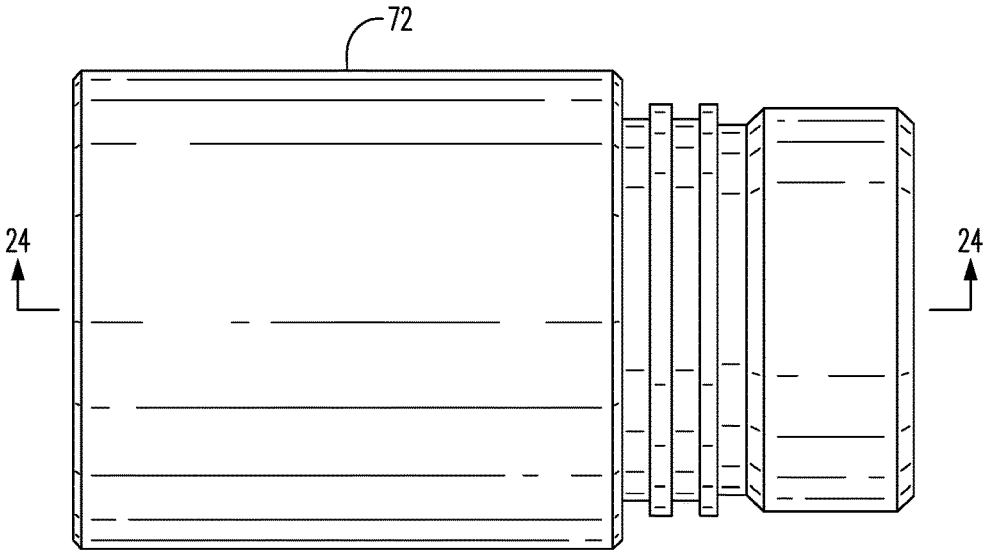
FIG. 23 is a side view of a top sub of a gun system in accordance with an embodiment.
Figure 24:
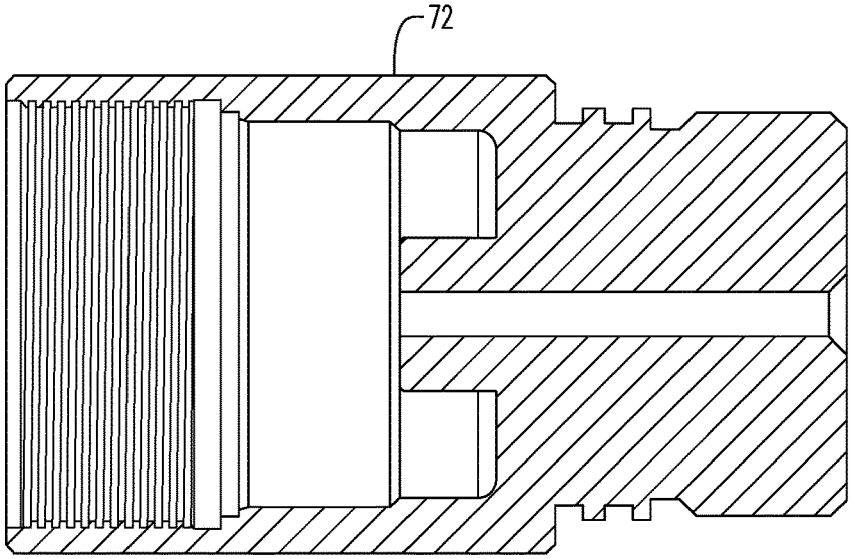
FIG. 24 is a side cut view of the top sub shown in FIG. 23.
Figure 25:
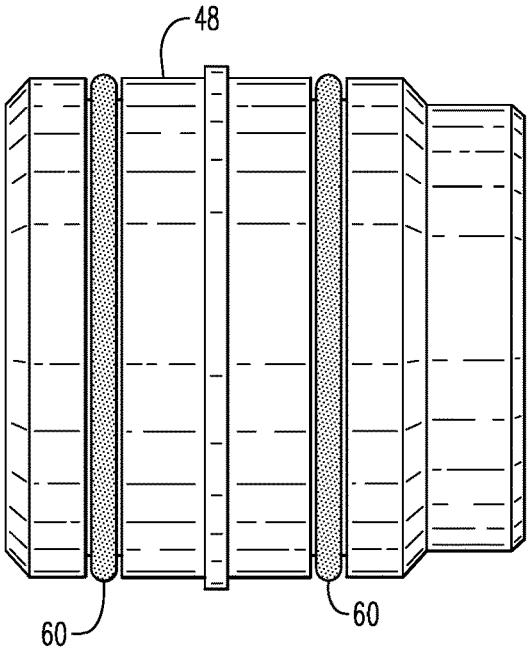
FIG. 25 is a side view of a tandem seal adapter of a gun system in accordance with an embodiment.
Figure 26:
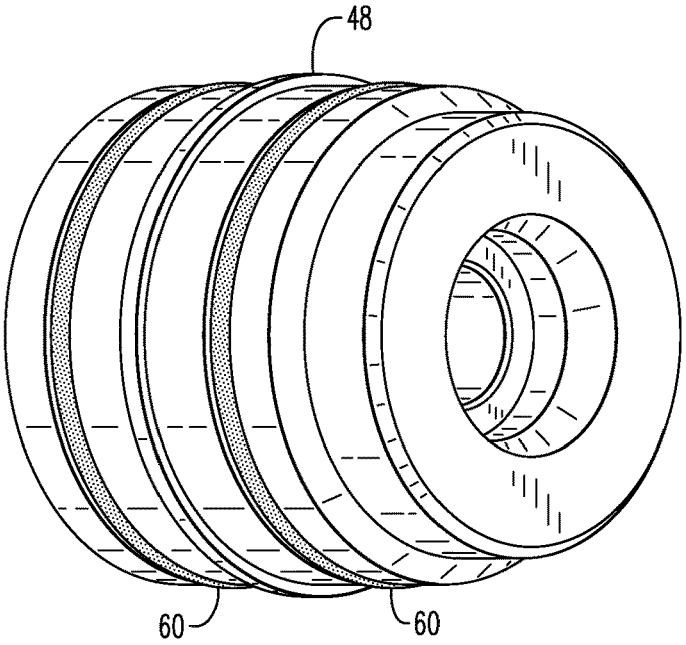
FIG. 26 is a perspective view of the tandem seal adapter shown in FIG. 25.
Figure 27:
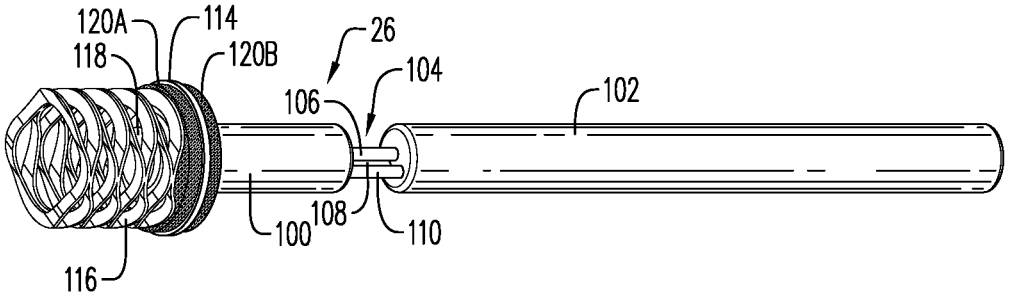
FIG. 27 is a perspective view of a detonator in accordance with an embodiment.
Figure 28:
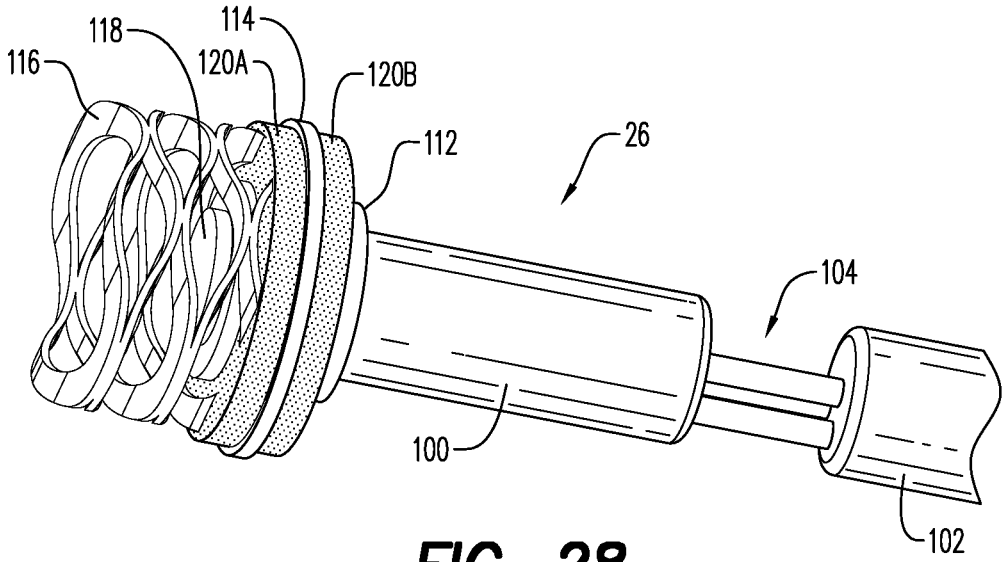
FIG. 28 is a detailed perspective view of the detonator shown in FIG. 27.
Figure 31:
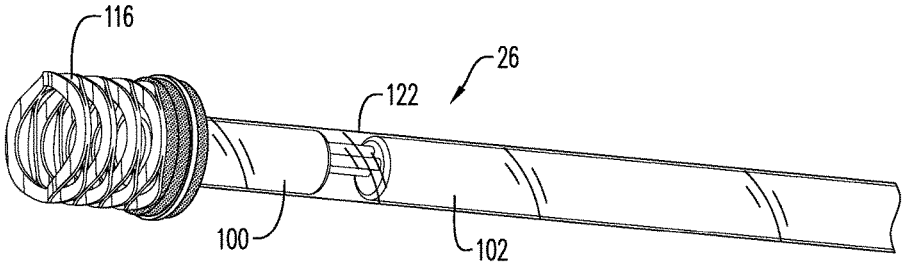
FIG. 31 is another detailed perspective view of the detonator shown in FIG. 27, with a crimp sleeve.

In an embodiment, on location, to complete the assembly, the method further comprises the steps of threading on the previously assembled components a bottom sub (element 70 on FIGS. 1 and 20);

installing and connecting the detonator;

pushing in a tandem seal adapter with o-rings onto the first gun assembly;

pushing in a bulkhead (element 58 in FIG. 19) onto the tandem seal adapter, if the bulkhead and the tandem seal adapter are not pre-assembled;

threading a subsequent gun assembly onto the first gun assembly or threading a top sub (element 72 in FIGS. 1, 23 and 24) onto a topmost assembled gun assembly, for connection to a quick change assembly.

Of course, the scope of the perforation gun system, various perforation gun components, the perforation gun system kit, and the method for assembling a perforation gun system should not be limited by the various embodiments set forth herein, but should be given the broadest interpretation consistent with the description as a whole. The components and methods described and illustrated are not limited to the specific embodiments described herein, but rather, features illustrated or described as part of one embodiment can be used on or in conjunction with other embodiments to yield yet a further embodiment. Further, steps described in the method may be utilized independently and separately from other steps described herein. Numerous modifications and variations could be made to the above-described embodiments without departing from the scope of the FIGS. and claims, as apparent to a person skilled in the art.

In this specification and the claims that follow, reference will be made to a number of terms that have the following meanings. The singular forms "a," "an" and "the" include plural referents unless the context clearly dictates otherwise. Further, reference to "top," "bottom," "front," "rear," and the like are made merely to differentiate parts and are not necessarily determinative of direction. Similarly, terms such as "first," "second," etc. are used to identify one element from another, and unless otherwise specified are not meant to refer to a particular order or number of elements.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

As used in the claims, the word "comprises" and its grammatical variants logically also subtend and include phrases of varying and differing extent such as for example, but not limited thereto, "consisting essentially of" and "consisting of."

Advances in science and technology may make equivalents and substitutions possible that are not now contemplated by reason of the imprecision of language; these variations should be covered by the appended claims. This written description uses examples to disclose the perforation gun system, various perforation gun components, the perforation gun system kit, and the method for assembling a perforation gun system, including the best mode, and also to enable any person of ordinary skill in the art to practice same, including making and using any devices or systems and performing any incorporated methods. The patentable scope of the perforation gun system, various perforation gun components, the perforation gun system kit, and the method for assembling a perforation gun system is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

What is claimed is:

1. A perforating gun, comprising:

an outer gun carrier;

a charge holder positioned within the outer gun carrier and including at least one shaped charge;

a detonator contained entirely within the outer gun carrier, the detonator including a detonator body containing detonator components, a wireless signal-in connector, a wireless through wire connector, and a wireless ground contact connector, and an insulator electrically isolating the wireless signal-in connector from the wireless through wire connector; and, a bulkhead, wherein the bulkhead includes a contact pin in wireless electrical contact with the wireless signal-in connector, wherein at least a portion of the bulkhead is contained within a tandem seal adapter, and the wireless ground contact connector is in wireless electrical contact with the tandem seal adapter.

2. The perforating gun of claim 1, further comprising a through wire for relaying an electrical signal along a length of the charge holder, wherein the through wire is a wire and the wireless through wire connector is in electrical contact with the through wire.

3. The perforating gun of claim 1, wherein the charge holder is an injection molded part.

4. The perforating gun of claim 1, wherein the contact pin transfers an electrical signal from a previous wellbore tool to the wireless signal-in connector.

5. The perforating gun of claim 1, further comprising a top connector, wherein the detonator is positioned within the top connector.

6. The perforating gun of claim 5, wherein the top connector is an injection molded part.

7. The perforating gun of claim 1, wherein the detonator includes a signal-in wire electrically connected to the wireless signal-in connector and a ground wire electrically connected to the wireless ground contact connector.

8. The perforating gun of claim 1, wherein the detonator is configured for being electrically contactably received within the perforating gun without using a wired electrical connection, and the wireless signal-in connector, the wireless through-wire connector, and the wireless ground contact connector together are configured to replace the wired electrical connection and to complete an electrical connection merely by contact.

9. A modular detonator, comprising:

a detonator body containing detonator components;

a wireless signal-in connector;

a wireless through wire connector;

a wireless ground contact connector;

a signal-in wire electrically connecting at least in part the wireless signal-in connector to at least one of the detonator components; and, an insulator electrically isolating the wireless signal-in connector from the wireless through wire connector, wherein the wireless signal-in connector is configured for making wireless electrical contact with an electrical contact of a bulkhead assembly contained at least in part within a tandem seal adapter when the modular detonator is received within a gun assembly of a perforating gun system, and the wireless ground contact connector is configured for making wireless electrical contact with the tandem seal adapter when the modular detonator is received within the gun assembly of the perforating gun system.

10. The modular detonator of claim 9, further comprising a detonating cord connecting portion, wherein the detonating cord connecting portion is sized to retain a detonating cord and positioned to energetically couple the detonating cord to the detonator.

11. The modular detonator of claim 9, the modular detonator further comprising a ground wire electrically connected to the wireless ground contact connector.

12. The modular detonator of claim 9, wherein the modular detonator is configured for being electrically contactably received within the gun assembly of the perforating gun system without using a wired electrical connection, and the wireless signal-in connector, the wireless through-wire connector, and the wireless ground contact connector together are configured to replace the wired electrical connection and to complete an electrical connection merely by contact.

13. A method for assembling a perforation gun system, comprising:

(a) inserting a charge holder within a hollow interior of an outer gun carrier, wherein the charge holder includes a detonating cord connected to the charge holder and at least one shaped charge;

(b) inserting a top connector into the outer gun carrier adjacent to the charge holder, the top connector comprising a hollow channel;

(c) inserting a detonator into the hollow channel of the top connector, the detonator including a detonator body containing detonator components, a wireless signal in connector, a wireless through wire connector, and a wireless ground contact connector, and an insulator electrically isolating the wireless signal in connector from the wireless through wire connector;

(d) connecting a through wire to the wireless through wire connector;

(e) energetically coupling the detonating cord to the detonator; and, (f) transporting the perforation gun system to a wellbore site, wherein at least one of steps (a), (b), and (d) is performed before transporting the perforation gun system, and step (c) is performed at the wellbore site.

14. The method of claim 13, wherein inserting the detonator into the outer gun carrier includes pushing the detonator into the outer gun carrier.

15. The method of claim 13, wherein the through wire is a wire, and the wireless through wire connector of the detonator is in electrical contact with the through wire.

16. The method of claim 13, further comprising connecting a bulkhead into the outer gun carrier, wherein the bulkhead includes a contact pin and connecting the bulkhead into the outer gun carrier includes placing the contact pin in wireless electrical contact with the wireless signal in bulkhead connector.

17. The method of claim 13, wherein one or more of steps (a), (b)(e), and (d) is performed at a factory or a facility that is not a wellbore site.

18. The method of claim 13, further comprising performing a continuity test to ensure continuity between one or more electrical connections of the perforation gun system.

19. The method of claim 13, wherein performing steps (a) to (e) a first time with a first set of components completes a first perforating gun segment and the method further comprises:

performing steps (a) to (e) a second time with a second set of components to complete a second perforating gun segment; and connecting the second perforating gun segment to the first perforating gun segment.

20. The method of claim 13, wherein the detonator further includes a signal-in wire electrically connecting at least in part the wireless signal-in connector to at least one of the detonator components.

* * * * *